US009506434B2

(12) United States Patent
Coldren

(10) Patent No.: US 9,506,434 B2
(45) Date of Patent: Nov. 29, 2016

(54) DUAL CHECK FUEL INJECTOR WITH SINGLE ACTUATOR

(75) Inventor: Dana R. Coldren, Secor, IL (US)

(73) Assignee: Caterpillar Inc., Peoria, IL (US)

( * ) Notice: Subject to any disclaimer, the term of this patent is extended or adjusted under 35 U.S.C. 154(b) by 1125 days.

(21) Appl. No.: 13/597,924

(22) Filed: Aug. 29, 2012

(65) Prior Publication Data

US 2014/0061326 A1 Mar. 6, 2014

(51) Int. Cl.

| | |
|---|---|
| ***F02M 47/02*** | (2006.01) |
| ***F02M 43/04*** | (2006.01) |
| ***F02M 45/08*** | (2006.01) |
| ***F02M 61/04*** | (2006.01) |
| ***F02M 61/18*** | (2006.01) |

(52) U.S. Cl.

CPC ..... *F02M 43/04* (2013.01); *F02M 45/086* (2013.01); *F02M 61/045* (2013.01); *F02M 61/1826* (2013.01)

(58) Field of Classification Search

CPC .. F02M 43/04; F02M 61/045; F02M 45/086; F02M 61/1826

USPC ..... 239/5, 408, 410, 413, 414, 88, 96; 123/304, 445, 446, 525

See application file for complete search history.

(56) References Cited

U.S. PATENT DOCUMENTS

| | | | | |
|---|---|---|---|---|
| 3,339,848 | A * | 9/1967 | Geiger | F02M 45/086 239/453 |
| 6,298,833 | B1 * | 10/2001 | Douville | F02D 19/0684 123/27 GE |
| 6,439,192 | B1 | 8/2002 | Ouellette et al. | |
| 6,484,699 | B2 | 11/2002 | Paul et al. | |
| 6,601,566 | B2 | 8/2003 | Gillis et al. | |
| 6,705,543 | B2 | 3/2004 | Carroll, III et al. | |
| 6,769,635 | B2 * | 8/2004 | Stewart | F02M 45/02 123/299 |
| 6,776,139 | B1 | 8/2004 | Spoolstra | |
| 6,976,760 | B2 | 12/2005 | Ito et al. | |
| 7,086,377 | B2 | 8/2006 | Best | |
| 7,243,862 | B2 | 7/2007 | Dingle | |
| 7,373,931 | B2 * | 5/2008 | Lennox | F02D 19/0605 123/27 GE |
| 7,438,238 | B2 | 10/2008 | Date et al. | |
| 7,891,579 | B2 | 2/2011 | Mashida et al. | |
| 2006/0289681 | A1 | 12/2006 | Boecking | |
| 2012/0325350 | A1 * | 12/2012 | Kim | F02D 19/0694 137/596 |

* cited by examiner

*Primary Examiner* — Arthur O Hall
*Assistant Examiner* — Joel Zhou

(57) ABSTRACT

A fuel injector includes first and second check valve members that open and close first and second nozzle outlet sets, respectively, to inject two fuels that differ in at least one of chemical identity, pressure and molecular state. The first check valve member defines a through passage, includes a closing hydraulic surface exposed to fluid pressure in the first control chamber, and moves into and out of contact with a first seat on an injector body. The second check valve member includes a closing hydraulic surface exposed to fluid pressure in a second control chamber, and moves into and out of contact with a second seat located on the first check valve member. A control valve member is movable between first and second positions that respectively block and allow fluid communication between the first and second control chambers and a drain outlet.

15 Claims, 2 Drawing Sheets

DUAL CHECK FUEL INJECTOR WITH SINGLE ACTUATOR

TECHNICAL FIELD

The present disclosure relates generally to fuel injectors, and more particularly to a fuel injector with first and second check valve members controlled by a single actuator.

BACKGROUND

Over the years, fuel injectors have developed an ever growing range of capabilities for varying injection timings, injection flow rates, spray configurations, injection pressures and many others. These expanded capabilities have often been accompanied by increased complexity, increased part count, and additional electrical actuators. More recently, there has been a trend in the industry to equip fuel injectors with an ability to inject two fuels that differ in at least one of chemical identity, pressure and molecular state. While the art is filled with complicated looking fuel injectors with the ability to supposedly perform a wide variety of fuel injection strategies, few of these fuel injector designs have a structure suitable for mass production. In one specific example, U.S. Pat. No. 7,891,579 teaches a fuel injector that is controlled with a single electrical actuator while claiming to have the ability to inject both high pressure liquid fuel and gaseous fuel through two nozzle outlet sets.

The present disclosure is directed toward one or more of the problems set forth above.

SUMMARY

A fuel injector includes an injector body that defines a first nozzle outlet set, a second nozzle outlet set and a drain outlet. A first nozzle chamber, a second nozzle chamber, a first control chamber and a second control chamber are all disposed within the injector body. A first check valve member defines a through passage and is positioned entirely inside the injector body with a closing hydraulic surface exposed to fluid pressure in the first control chamber. The first check valve member is movable between a closed position in contact with a first seat on the injector body covering the first nozzle outlet set to fluidly block the first nozzle chamber to the first nozzle outlet set, and an open position out of contact with the first seat to fluidly connect the first nozzle chamber to the first nozzle outlet set. A second check valve member is positioned entirely inside the injector body with a closing hydraulic surface exposed to fluid pressure in the second control chamber. The second check valve member is movable between a closed position in contact with a second seat on the first check valve member to fluidly block the second nozzle chamber to the through passage and the second nozzle outlet set, and an open position out of contact with the second seat to fluidly connect the second nozzle chamber to the through passage and the second nozzle outlet set. A control valve member is positioned in the injector body and movable between a first position at which the first control chamber and the second control chamber are fluidly blocked to the drain outlet, and a second position at which the first control chamber and the second control chamber are fluidly connected to the drain outlet.

In another aspect, a method of operating the fuel injector includes injecting a first fuel through the first nozzle outlet set and the second nozzle outlet set. A second fuel is injected through the second nozzle outlet set. The injecting steps are performed by simultaneously relieving pressure in the first control chamber and the second control chamber by moving the control valve member from the first position to the second position.

DETAILED DESCRIPTION

Figure 1:
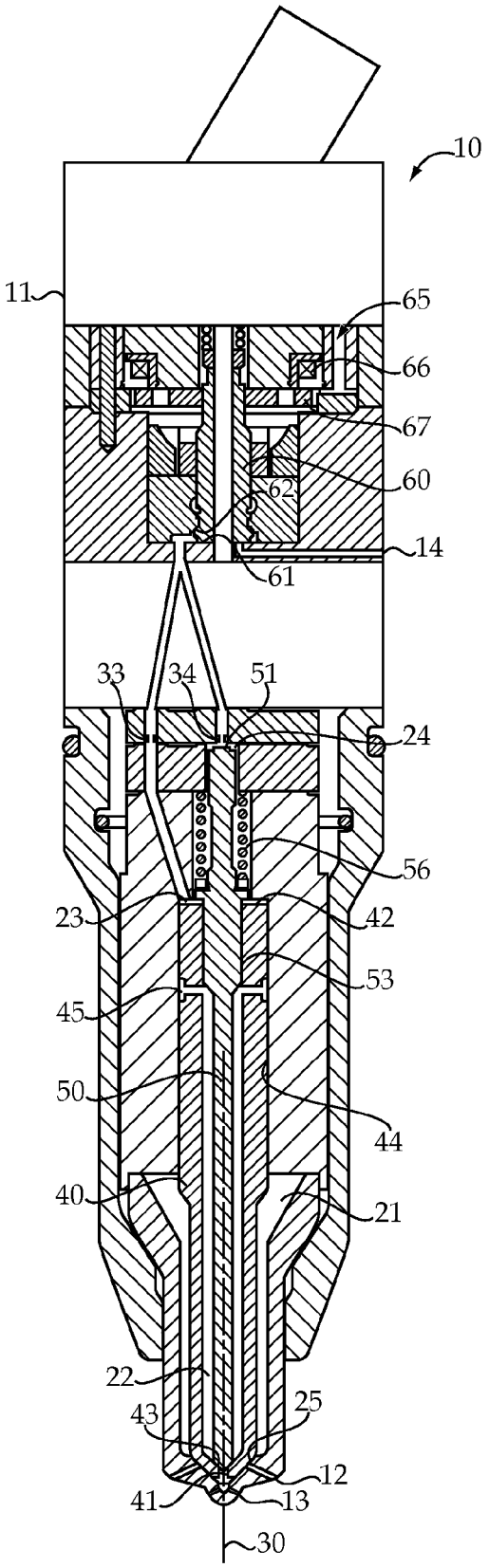
FIG. 1 is a front sectioned view of a fuel injector according to the present disclosure.
Figure 2:
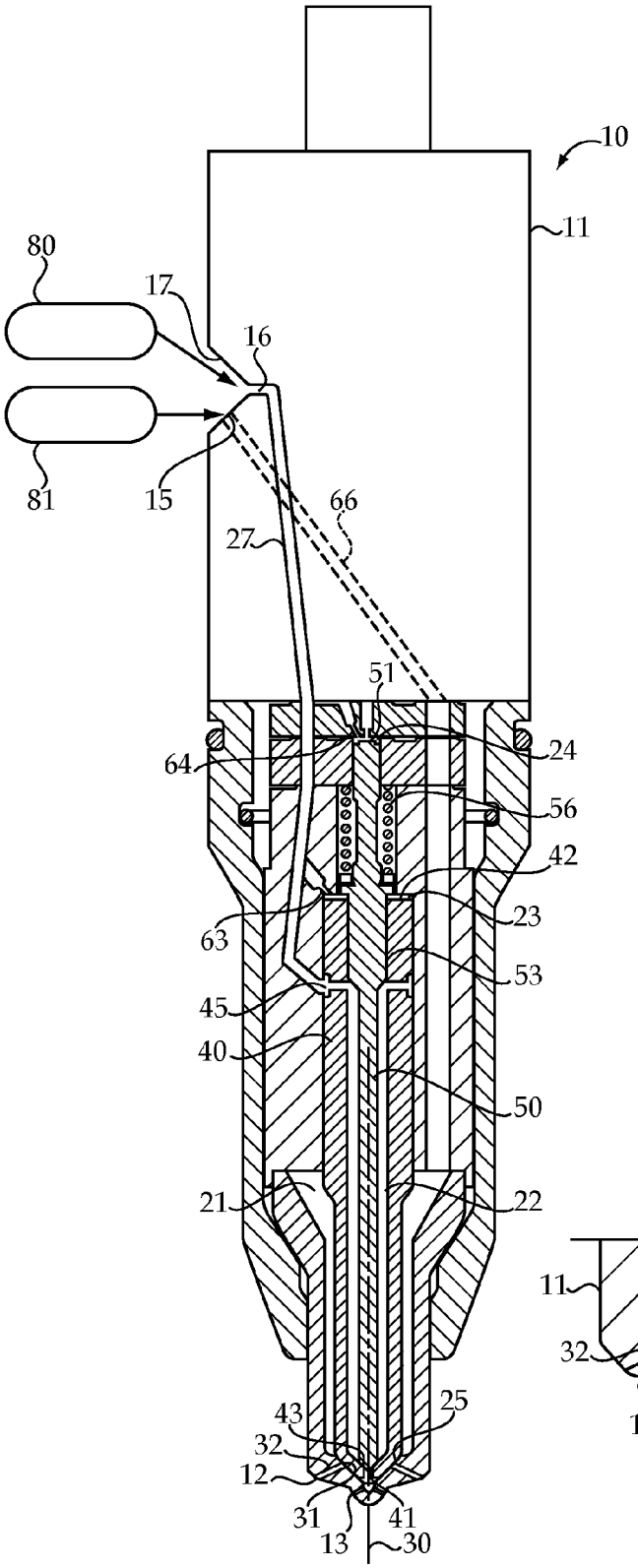
FIG. 2 is a side sectioned view through the fuel injector of FIG. 1.
Figure 3:
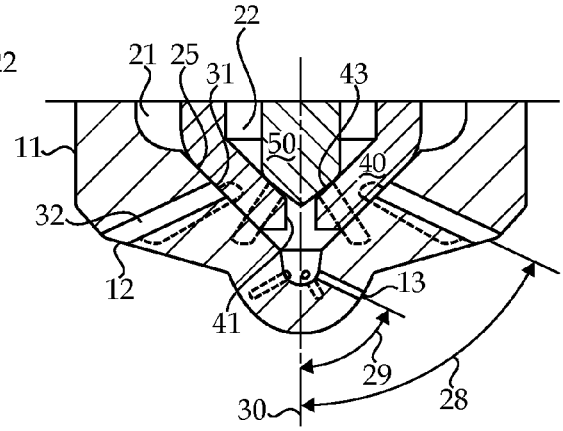
FIG. 3 is an enlarged sectioned view through the tip portion of the fuel injector of FIGS. 1 and 2.

Referring to FIGS. 1-3, a fuel injector 10 includes an injector body 11 that defines a first nozzle outlet set 12, a second nozzle outlet set 13 and a drain outlet 14. Disposed within injector body 11 are a first nozzle chamber 21, a second nozzle chamber 22, a first control chamber 23 and a second control chamber 24. A first check valve member 40 defines a through passage 41 and is positioned entirely inside injector body 11. The first check valve member 40 includes a closing hydraulic surface 42 exposed to fluid pressure in the first control chamber 23. The first check valve member is movable between a closed position in contact with a first seat 25 on injector body 11 covering the first nozzle outlet set 12 to fluidly block the first nozzle chamber 21 to the first nozzle outlet set 12, and an open position out of contact with the first seat 25 to fluidly connect the first nozzle chamber 21 to the first nozzle outlet set 12. A second check valve member 50 is positioned entirely inside injector body 11 and has a closing hydraulic surface 51 exposed to fluid pressure in the second control chamber 24. The second check valve member 50 is movable between a closed position in contact with a second seat 43 on the first check valve member 40 to fluidly block the second nozzle chamber 22 to the through passage 41 and the second nozzle outlet set 13, and an open position out of contact with the second seat 43 to fluidly connect the second nozzle chamber 22 to the through passage 41 and the second nozzle outlet set 13. A control valve member 60 is positioned in the injector body and movable between a first position at which the first control chamber 23 and the second control chamber 24 are fluidly blocked to the drain outlet 14, and a second position at which the first control chamber 23 and the second control chamber 24 are fluidly connected to the drain outlet 14.

Although fuel injector 10 has the ability to inject two fuels that differ in at least one of chemical identity, pressure and molecular state, fuel injector 11 includes exactly one electrical actuator 65 to control both the first and second check valve members 40, 50 to facilitate injection events. For instance, the first fuel might be natural gas, and the second fuel might be liquid diesel fuel. In such a case, a small pilot injection quantity of diesel fuel might be compression ignited to in turn ignite a much larger charge of natural gas. This might be accomplished by fluidly connecting a gaseous fuel common rail 81 to a first fuel inlet 15 that is in fluid communication with the first nozzle chamber 21 via a first nozzle supply passage 66. Likewise, a liquid diesel common rail 80 might be fluidly connected to a second fuel inlet 16 that is fluidly connected to the second nozzle chamber 22 by a second nozzle supply passage 27. In the illustrated embodiment, inlets 15 and 16 open through a common conical seat 17, allowing both fuels to be supplied via a coaxial quill assembly (not shown). Also, the first check valve member 40 and the second check valve member 50 may move along a common centerline 30 of injector body 11 to facilitate the respective fuel injection events.

As best shown in FIG. 3, first check valve member 40 preferably seats at first conical seat 25 that is located between the first nozzle chamber 21 and an inlet opening 31 to each nozzle passage 32 of the first nozzle outlet set 12. This might be accomplished by having a slight angular difference (e.g. 0.5°) between the conical seat 25 and the conically shaped end of first check valve member 40. This structure also facilitates the first check valve member 40 covering the first nozzle outlet set 12 when in its downward closed position, as shown. Although not necessary, the first nozzle outlet set 12 may have a first total flow area, and the second nozzle outlet set 13 may have a second total flow area that is less than the first total flow area. This is shown, for example in FIG. 3 where the diameter of the respective flow orifices in the first nozzle outlet set 12 are larger than those of the second nozzle outlet set 13. Likewise, the structure of the present disclosure allows for the first nozzle outlet set 12 to define a first spray angle 28 with respect to centerline 30. The second nozzle outlet set may define a second spray angle 29 with respect to centerline 30 that is different from the first spray angle 28. Thus, the respective flow areas and spray angles of the two nozzle outlet sets can be made to suit the needs of a particular engine application.

Referring back to FIGS. 1 and 2, the first check valve member 40 may have a guide interaction 44 with injector body 11, whereas the second check valve member 50 may have a guide interaction 53 with the first check valve member 40. Although not necessary, fuel injector 11 may utilize exactly one spring 56 that is operably positioned to bias the first and second check valve members 40, 50 toward there respective closed positions as shown. It should be noted that the first nozzle outlet set 12 and the second nozzle outlet set 13 are both fluidly connected to the first nozzle chamber 21 when the first check valve member 40 is at its open upward position. Likewise, the illustrated structure is such that the second check valve member 50 acts as a stop for the first check valve member 40. As such, the second check valve member will be at a closed position in contact with second seat 43 when the first check valve member 40 is at its upward open position. Thus, one could expect the injection of the first fuel to pass through both the first nozzle outlet set 12 and second nozzle outlet set 13. However, injection of the second fuel may be primarily limited to the second nozzle outlet set 13, and may only occur during a brief instant when second check valve member 50 quickly moves upward while a more sluggish first check valve member 40 stays in its downward closed position.

In the illustrated version shown, the fast action of second check valve member 50 relative to a more sluggish movement of first check valve member 40 may be accomplished using a variety of strategies such that fuel injector 11 may be particularly well suited for use with dual fuel engines. In other words, a typical injection scenario might include a brief injection of liquid diesel by quickly moving second check valve member 50 from its closed position to its upward open position, followed by a much larger injection of natural gas when the first check valve member 40 moves to its open position. In the illustrated embodiment, this action may be accomplished by arranging the first control chamber 23 to be fluidly connected to drain outlet 14 through a first orifice 33 when control valve member 60 is at its second position. The second control chamber 24 may be fluidly connected to the drain outlet 14 through a second orifice 34 when the control valve member 60 is at its second position. The first orifice 33 may have a first flow area, and the second orifice 34 may have a second flow area. Orifices 33 and 34 are often referred to in the art as A-orifices. In the illustrated embodiment, the more sluggish action of the first check valve member may be accomplished by setting the first flow area to be smaller than the second flow area. In addition, when the first check valve member 40 moves from its closed position to its open position, a first volume of fluid is displaced from the first controlled chamber 23. Likewise, when the second check valve member 50 moves from its closed position to its open position, a second volume of fluid is displaced from the second control chamber 24. By designing the injector 11 so that the first volume of fluid is greater than the second volume of fluid, combined with the fact that the first orifice 33 is smaller than the second orifice 34, the relative movement rates of the first check valve member 40 and the second check valve member 50 can be accomplished. The first check valve member 40 may also have more mass (i.e. inertia) than the second check valve member 50. These design features might be set so that the fuel injector 11 injects a known small pilot quantity of liquid diesel fuel toward the beginning of each combined injection event by the quick action of the second check valve member 50 moving from its closed position toward its open position. While this small injection event is occurring, the more sluggish moving first check valve member 40 will move upward to commence the gaseous fuel injection event while simultaneously terminating the liquid diesel injection event. This strategy might be particularly useful in dual fuel engines where a small pilot injection of diesel fuel is compression ignited to in turn ignite a much larger charge of gaseous fuel.

The control aspect of the fuel injector 11 could be accomplished in a number of ways including but not limited to a three way valve that alternately connects the control chambers 23, 24 to either the drain outlet 14 or the high pressure inlet pressure 16. Alternatively, the control strategy may utilize a simple two way valve that operates to either open or close a fluid connection between the control chambers 23, 24 and the drain outlet 14. Either control valve structure would fall within the scope of the present disclosure. In the specific example illustrated, the control valve member 60 is trapped to move between contact with a low pressure seat 61 at the first position and a high pressure seat 62 at the second position. With this structure, both the first control chamber 23 and the second control chamber 24 will be fluidly connected to the liquid fuel inlet 16 past the high pressure seat 62 when the control valve member 60 is at the first position. When the control valve member is at its second position, both the first control chamber 23, and the second control chamber 24 will be fluidly blocked to the liquid fuel inlet 16 but fluidly connected to low pressure drain outlet 14. This action serves to relieve pressure in the respective control chambers 23 and 24, and hence the respective pressures acting on closing hydraulic surface 42 and closing hydraulic surface 51 of first and second check valve member 40, 50, respectively. Although not necessary, first control chamber 23 may always be fluidly connected to liquid fuel inlet 16 via a Z-orifice 63, and second control chamber 24 may always be fluidly connected to high pressure fuel inlet 16 via Z-orifice 64. The flow areas through the Z-orifices 63 and 64 may also have their flow areas adjusted as another design choice in facilitating the relative movement action of the first and second check valve members 40, 50 as described above. In the illustrated embodiment, the control valve member 60 is shown as being attached to an armature 67 of an electrical actuator 65 that also includes a coil 66.

Nevertheless, those skilled in the art will appreciate that other electrical actuator strategies that may or may not include a direct physical connection to the control valve member 60 would also fall within the scope of the present disclosure. Also, other electrical actuators, such as maybe a piezo actuator could also be used in place of the solenoid of the illustrated embodiment without departing from the scope of the present disclosure.

In order to better facilitate the staggered movement action of the respective check valve members 40, 50, it might be necessary to set the control valve seat area to be sized slightly greater than a combined cross sectional area of the A-orifices 33 and 34. This will help to insure that the flow area past control valve member 60 does not create a flow restriction in the system that could undermine predictability and also make it more difficult to mass produce fuel injector 11 with consistent results from different injectors from an identical control signal.

As implicitly suggested, the fuel injector 11 utilizes liquid diesel fuel not only as an injection medium, but also as the control fluid. Also, by fluidly supplying second nozzle chamber 22 via side opens 45 in the first check valve member 40, the liquid diesel fuel can also find its way into the guide interaction 44 between first check valve member 40 and injector body 11 to facilitate lubrication. Likewise, one could expect small sufficient amounts of liquid diesel fuel to find its way to better facilitate lubrication interaction between the first check valve member 40 and the first seat 25. Thus, in the specific design shown, the liquid diesel fuel acts as a control fluid, as a lubrication fluid and as an injection medium for pilot injection and compression ignition to facilitate ignition of a larger charge of gaseous fuel. These strategies might further be accomplished by setting the liquid fuel pressure in liquid fuel common rail 80 to be slightly higher (maybe about 5 MPa) than the gas pressure in gaseous fuel common rail 85.

INDUSTRIAL APPLICABILITY

The fuel injector 10 of the present disclosure finds potential application wherever there is a desire to inject two fuels that differ in at least one of chemical identity, pressure and molecular state. Fuel injector 10 might be particularly well suited to use in dual fuel engines that utilize natural gas as a first fuel, and liquid diesel fuel as a second fuel in a compression ignition engine. Finally, the present disclosure might be particularly well suited to dual fuel engines where, for whatever reason, each fuel injector 10 is limited to a single electrical actuator, but retains a need to control injection events for two different fuels.

Prior to an injection event, the electrical actuator 65 is de-energized, high pressure prevails in both first control chamber 23 and second control chamber 24, and both first check valve member 40 and second check valve member 50 are in their downward closed positions with no fuel injection taking place. At around top dead center in a given engine cycle, the electrical actuator 65 may be energized to move control valve member 60 from first position to its second position. This action, will simultaneously fluidly connect both first control chamber 23 and second control chamber 24 to drain outlet 14 relieving pressure on the closing hydraulic surface 42 of first check valve member 40 and the closing hydraulic surface 51 of second check valve member 50. Because second check valve member 50 is designed to move much faster than first check valve member 40, relieving pressure on closing hydraulic surface 51 causes second check valve member 50 to quickly lift out of contact with second seat 43 to open a fluid connection between second nozzle chamber 22 and the second nozzle outlet set 13 through the through passage 41. This allows for liquid diesel to commence spraying out of second nozzle outlet set 13. A fraction of a second later, the first check valve member 40 will begin moving upward toward its open position. During this brief transition, both gaseous and liquid fuels might be briefly simultaneously injected. When the first check valve member 40 reaches its upper position, its motion is stopped when second seat 43 comes in contact with second check valve member 50. This abruptly stops the injection of liquid diesel fuel while natural gas will continue to be injected through both first nozzle outlet set 12 and second nozzle outlet set 13 as long as the electrical actuator 65 remains energized. Thus, the injection of the liquid diesel fuel involves moving the liquid diesel fuel through the through passage 41 defined by the first check valve member 40. Also, the liquid diesel injection event is accomplished by moving the second check valve member 50 toward its open position faster than the first check valve member 40 moves toward its open position. The injection event is ended by de-energizing electrical actuator 65 and allowing control valve member 60 to move back from its second position to its first position to close the fluid connection to drain outlet 14. This movement of control valve member 60 may be accomplished by a biasing spring in a well known manner. This action resumes pressure in both first control chamber 23 and second control chamber 24. The gaseous fuel injection event is then ended by moving the first check valve member from its upward open position down to its closed position in contact with first seat 25 while maintaining the second check valve member 50 in its closed position in contact with second seat 43 throughout the movement. The same quick action in the opening direction for second check valve member 50 also causes it to stay in contact with the first check valve member 40 during the closing procedure. Thus, the liquid diesel fuel serves several purposes in fuel injector 10 including a lubrication fluid for the moving parts within the fuel injector, as a pilot injection fuel for compression igniting the gaseous fuel and as the control fluid for controlling the movement of the first and second check valve members 40, 50. This last aspect is facilitated by fluidly connecting the first control chamber 23 and the second control chamber to the liquid fuel inlet 16, but not the gaseous fuel inlet 15.

Although fuel injector 10 may have lesser versatility than a counterpart fuel injector with two electrical actuators, by appropriately sizing the control volumes, the amount of fluid displaced, the size of the various orifices and so on, a single actuator fuel injector 10 can be made to be particularly well suited to a standard dual fuel injection cycle associated with a engine that burns natural gas and liquid diesel fuels.

It should be understood that the above description is intended for illustrative purposes only, and is not intended to limit the scope of the present disclosure in any way. Thus, those skilled in the art will appreciate that other aspects of the disclosure can be obtained from a study of the drawings, the disclosure and the appended claims.

What is claimed is:

1. A fuel injector comprising:

an injector body defining a first nozzle outlet set, a second nozzle outlet set and a drain outlet, and having disposed therein a first nozzle chamber, a second nozzle chamber, a first control chamber and a second control chamber;

a first check valve member defining a through passage and being positioned entirely inside the injector body with a closing hydraulic surface exposed to fluid pressure in the first control chamber, and being movable between a closed position in contact with a first seat on the injector body covering the first nozzle outlet set to fluidly block the first nozzle chamber to the first nozzle outlet set, and an open position out of contact with the first seat to fluidly connect the first nozzle chamber to the first nozzle outlet set;

a second check valve member positioned entirely inside the injector body with a closing hydraulic surface exposed to fluid pressure in the second control chamber, and being movable between a closed position in contact with a second seat on the first check valve member to fluidly block the second nozzle chamber to the through passage and the second nozzle outlet set, and an open position out of contact with the second seat to fluidly connect the second nozzle chamber to the through passage and the second nozzle outlet set;

one control valve member positioned in the injector body and movable between a first position at which the first control chamber and the second control chamber are both fluidly blocked to the drain outlet, and a second position at which the first control chamber and the second control chamber are both fluidly connected to the drain outlet; and wherein the fuel injector further consists of exactly one spring operably positioned to bias the first and second check valve members toward the respective closed positions.

2. The fuel injector of claim 1 wherein the injector body has a centerline;

the first seat being located between the first nozzle chamber and an inlet opening of each nozzle passage of the first nozzle outlet set.

3. The fuel injector of claim 1 wherein the first control chamber is fluidly connected to the drain outlet through a first orifice, with a first flow area, when the control valve member is at the second position;

the second control chamber is fluidly connected to the drain outlet through a second orifice, with a second flow area, when the control valve member is at the second position; and the first flow area is smaller than the second flow area.

4. The fuel injector of claim 1 wherein the first nozzle outlet set has a first total flow area;

the second nozzle outlet set has a second total flow area that is less than the first total flow area.

5. The fuel injector of claim 1 wherein the injector body has a centerline;

the first nozzle outlet set defines a first spray angle with respect to the centerline;

the second nozzle outlet set defines a second spray angle that is different from the first spray angle.

6. The fuel injector of claim 1 wherein the first check valve member has a guide interaction with the injector body; and the second check valve member has a guide interaction with the first check valve member.

7. The fuel injector of claim 1 wherein the control valve member is trapped to move between contact with a low pressure seat at the first position and a high pressure seat at the second position;

the injector body defines a fuel inlet;

the first control chamber and the second control chamber being fluidly connected to the fuel inlet past the high pressure seat when the control valve member is at the first position; and the first control chamber and the second control chamber are fluidly blocked to the fuel inlet when the control valve member is at the second position.

8. The fuel injector of claim 1 wherein the first check valve member displaces a first volume of fluid from the first control chamber when moving from the closed position to the open position;

the second check valve member displaces a second volume of fluid from the second control chamber when moving from the closed position to the open position; and the first volume is greater than the second volume.

9. The fuel injector of claim 1 wherein the first nozzle outlet set and the second nozzle outlet set are both fluidly connected to the first nozzle chamber when the first check valve member is at the open position.

10. The fuel injector of claim 1 wherein the second check valve member is at the closed position when the first check valve member is at the open position.

11. The fuel injector of claim 10 wherein the first nozzle outlet set and the second nozzle outlet set are both fluidly connected to the first nozzle chamber when the first check valve member is at the open position;

the control valve member is trapped to move between contact with a low pressure seat at the first position and a high pressure seat at the second position;

the injector body has a centerline and defines a first fuel inlet fluidly connected to the first nozzle chamber and a second fuel inlet fluidly connected to the second nozzle chamber;

the first control chamber and the second control chamber being fluidly connected to the second fuel inlet past the high pressure seat when the control valve member is at the first position;

the first control chamber and the second control chamber are fluidly blocked to the second fuel inlet when the control valve member is at the second position;

the first check valve member has a guide interaction with the injector body;

the second check valve member has a guide interaction with the first check valve member; and the first seat being located between the first nozzle chamber and an inlet opening of each nozzle passage of the first nozzle outlet.

12. The fuel injector of claim 11 wherein the first check valve member displaces a first volume of fluid from the first control chamber when moving from the closed position to the open position;

the second check valve member displaces a second volume of fluid from the second control chamber when moving from the closed position to the open position; and the first volume is greater than the second volume.

13. The fuel injector of claim 12 wherein the first control chamber is fluidly connected to the drain outlet through a first orifice, with a first flow area, when the control valve member is at the second position;

the second control chamber is fluidly connected to the drain outlet through a second orifice, with a second flow area, when the control valve member is at the second position; and the first flow area is smaller than the second flow area.

14. The fuel injector of claim 13 wherein the first nozzle outlet set has a first total flow area;

the second nozzle outlet set has a second total flow area that is less than the first total flow area.

15. The fuel injector of claim 14 wherein the injector body has a centerline;

the first nozzle outlet set defines a first spray angle with respect to the centerline;

the second nozzle outlet set defines a second spray angle that is different from the first spray angle.

* * * * *